US006655630B2

(12) United States Patent
Newman et al.

(10) Patent No.: US 6,655,630 B2
(45) Date of Patent: Dec. 2, 2003

(54) DISPENSER FOR PREMOISTENED WIPES

(75) Inventors: William R. Newman, Neenah, WI (US); Herb F. Velazquez, Neenah, WI (US); Ligia A. Rivera, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/222,171

(22) Filed: Aug. 16, 2002

(65) Prior Publication Data

US 2002/0190154 A1 Dec. 19, 2002

Related U.S. Application Data

(63) Continuation of application No. 09/545,995, filed on Apr. 10, 2000.

(60) Provisional application No. 60/132,024, filed on Apr. 30, 1999.

(51) Int. Cl.[7] ..... B65H 16/06; B65H 18/04; B65H 49/26; B65H 49/32; B65H 75/18

(52) U.S. Cl. ..... 242/598.6; 242/598.5; D6/523; D6/527

(58) Field of Search ..... 242/598.3, 598.5, 242/598.6; D6/518, 522, 523, 527

(56) References Cited

U.S. PATENT DOCUMENTS

| | | | | | |
|---|---|---|---|---|---|
| 1,003,995 | A | * | 9/1911 | Denoon, Jr. | 242/565 |
| 1,272,598 | A | * | 7/1918 | Baker | 242/598.3 |
| 1,664,392 | A | * | 4/1928 | Baruch | 242/422.5 |
| 2,182,831 | A | * | 12/1939 | Wagner | 242/564.4 |
| 2,422,749 | A | * | 6/1947 | Rougas | 242/598.3 |
| D148,484 | S | * | 1/1948 | Roche | D6/523 |
| 2,440,974 | A | | 5/1948 | Resch | |
| 2,487,763 | A | * | 11/1949 | Patterson et al. | 242/598.6 |

(List continued on next page.)

FOREIGN PATENT DOCUMENTS

| | | |
|---|---|---|
| EP | 0 122 809 A1 | 10/1984 |
| EP | 0 251 103 A1 | 1/1988 |
| EP | 0 501 905 A1 | 9/1992 |
| EP | 0 608 460 A1 | 8/1994 |
| EP | 0 608 460 B1 | 9/1998 |
| EP | 1 023 863 A1 | 8/2000 |
| EP | 1 048 257 A3 | 11/2000 |
| EP | 1 048 257 A2 | 11/2000 |
| GB | 990332 | 4/1965 |
| GB | 1324818 | 7/1973 |
| GB | 1 327 954 | 8/1973 |
| GB | 2 357 076 A | 6/2001 |
| WO | WO 93/17933 | 9/1993 |
| WO | WO 96/21388 A1 | 7/1996 |
| WO | WO 97/24054 | 7/1997 |
| WO | WO 98/08763 A1 | 3/1998 |
| WO | WO 99/06311 A2 | 2/1999 |
| WO | WO 99/01536 A1 | 4/1999 |
| WO | WO 00/00071 | 1/2000 |
| WO | WO 00/08998 | 2/2000 |

OTHER PUBLICATIONS

Derwent World Patent Database abstract of DE 3133237: Description of M. Scheepe, "Refill Pack of Moisture–Impregnated Tissues."

(List continued on next page.)

*Primary Examiner*—Emmanuel M. Marcelo
(74) *Attorney, Agent, or Firm*—Brinks Hofer Gilson & Lione

(57) ABSTRACT

A compact dispenser for both premoistened wipes and dry bathroom tissue. The dispenser includes a first compartment for the premoistened wipes. The premoistened wipes may be placed in a removable tray in the first compartment. The dry bathroom tissue may be supported on a roll bar and be partially positioned in a second compartment of the dispenser. The dispenser may be mounted to a conventional bathroom tissue fixture using a mounting device.

27 Claims, 11 Drawing Sheets

U.S. PATENT DOCUMENTS

| | | | | | |
|---|---|---|---|---|---|
| 2,561,584 | A | * | 7/1951 | McDonald | 242/598.3 |
| 2,606,724 | A | * | 8/1952 | Hertz | 242/598.1 |
| 2,805,030 | A | * | 9/1957 | Wolters | 242/560 |
| 3,310,353 | A | | 3/1967 | Cordis | |
| 3,368,522 | A | | 2/1968 | Cordis | |
| 3,467,330 | A | * | 9/1969 | Yavitch | 242/560.3 |
| 3,532,210 | A | | 10/1970 | Minion et al. | |
| 3,568,635 | A | | 3/1971 | Poitras et al. | |
| 3,592,161 | A | | 7/1971 | Hoffmann | |
| 3,603,519 | A | | 9/1971 | Brown | |
| 3,633,838 | A | | 1/1972 | Krueger | |
| 3,656,699 | A | | 4/1972 | Schnyder et al. | |
| 3,713,170 | A | | 1/1973 | Kaufman | |
| 3,729,145 | A | | 4/1973 | Koo et al. | |
| 3,754,804 | A | | 8/1973 | Cushman | |
| 3,756,483 | A | | 9/1973 | Schraeder | |
| 3,771,739 | A | | 11/1973 | Nelson | |
| 3,775,801 | A | | 12/1973 | Walker | |
| 3,780,908 | A | | 12/1973 | Fitzpatrick et al. | |
| 3,784,055 | A | | 1/1974 | Anderson | |
| 3,788,573 | A | | 1/1974 | Thomson et al. | |
| 3,795,355 | A | | 3/1974 | Gerstein | |
| 3,806,055 | A | | 4/1974 | Bauman | |
| 3,824,953 | A | | 7/1974 | Boone | |
| 3,836,044 | A | | 9/1974 | Tilp et al. | |
| 3,836,045 | A | | 9/1974 | Duhy et al. | |
| 3,837,595 | A | | 9/1974 | Boone | |
| 3,841,466 | A | | 10/1974 | Hoffman et al. | |
| 3,843,017 | A | | 10/1974 | Harrison | |
| 3,848,822 | A | | 11/1974 | Boone | |
| 3,865,271 | A | | 2/1975 | Gold | |
| 3,870,211 | A | * | 3/1975 | Schriever | 225/34 |
| 3,890,622 | A | | 6/1975 | Alden | |
| 3,913,522 | A | | 10/1975 | Light | |
| 3,943,859 | A | | 3/1976 | Boone | |
| 3,949,947 | A | | 4/1976 | Youngquist et al. | |
| 3,967,756 | A | | 7/1976 | Barish | |
| 3,970,215 | A | | 7/1976 | McLaren et al. | |
| 3,982,659 | A | | 9/1976 | Ross | |
| 3,986,479 | A | | 10/1976 | Bonk | |
| 3,994,417 | A | | 11/1976 | Boedecker | |
| 3,995,582 | A | | 12/1976 | Douglas | |
| 4,002,264 | A | | 1/1977 | Marchesani | |
| 4,004,687 | A | | 1/1977 | Boone | |
| 4,025,004 | A | | 5/1977 | Massey | |
| 4,043,519 | A | | 8/1977 | Suzuki et al. | |
| 4,069,789 | A | | 1/1978 | Fukagawa et al. | |
| 4,071,200 | A | | 1/1978 | Stone | |
| 4,098,469 | A | | 7/1978 | McCarthy | |
| 4,101,026 | A | | 7/1978 | Bonk | |
| 4,106,433 | A | | 8/1978 | Fernando et al. | |
| 4,106,616 | A | | 8/1978 | Boone | |
| 4,106,617 | A | | 8/1978 | Boone | |
| D249,604 | S | * | 9/1978 | Woo | D6/523 |
| 4,114,824 | A | | 9/1978 | Danielak | |
| 4,124,259 | A | | 11/1978 | Harris | |
| 4,131,195 | A | | 12/1978 | Worrell, Sr. | |
| 4,135,199 | A | | 1/1979 | Kurland et al. | |
| 4,135,678 | A | | 1/1979 | Williams | |
| 4,138,034 | A | | 2/1979 | McCarthy | |
| 4,179,078 | A | | 12/1979 | Mansfield | |
| 4,191,317 | A | | 3/1980 | Harkins | |
| 4,205,802 | A | | 6/1980 | Economakis | |
| 4,219,129 | A | | 8/1980 | Sedwick | |
| 4,222,621 | A | | 9/1980 | Greenlee et al. | |
| 4,235,333 | A | | 11/1980 | Boone | |
| 4,244,493 | A | | 1/1981 | Harrison | |
| 4,260,117 | A | | 4/1981 | Perrin et al. | |
| 4,274,573 | A | | 6/1981 | Finkelstein | |
| 4,294,389 | A | | 10/1981 | Falk et al. | |
| 4,328,907 | A | | 5/1982 | Beard | |
| 4,353,480 | A | | 10/1982 | McFadyen | |
| 4,363,454 | A | | 12/1982 | Mohar | |
| 4,375,874 | A | | 3/1983 | Leotta et al. | |
| 4,383,656 | A | | 5/1983 | Campbell | |
| 4,401,248 | A | | 8/1983 | Helms | |
| 4,411,374 | A | | 10/1983 | Hotchkiss | |
| 4,425,012 | A | | 1/1984 | Kley | |
| 4,427,159 | A | | 1/1984 | Miller et al. | |
| 4,428,497 | A | | 1/1984 | Julius et al. | |
| 4,432,504 | A | | 2/1984 | Pace | |
| 4,436,221 | A | | 3/1984 | Margulies | |
| 4,447,015 | A | | 5/1984 | Peterson | |
| 4,453,634 | A | | 6/1984 | Blumenthal | |
| 4,463,912 | A | | 8/1984 | Grunerud | |
| 4,467,974 | A | | 8/1984 | Crim | |
| 4,526,291 | A | | 7/1985 | Margulies | |
| 4,535,912 | A | | 8/1985 | Bonk | |
| 4,550,855 | A | | 11/1985 | Harrison | |
| 4,564,148 | A | | 1/1986 | Wentworth | |
| 4,566,606 | A | | 1/1986 | Kling | |
| 4,570,820 | A | | 2/1986 | Murphy | |
| 4,601,938 | A | | 7/1986 | Deacon et al. | |
| 4,607,809 | A | | 8/1986 | Sineni et al. | |
| 4,648,530 | A | | 3/1987 | Granger | |
| 4,659,028 | A | | 4/1987 | Wren | |
| 4,662,576 | A | | 5/1987 | Paul | |
| 4,662,577 | A | | 5/1987 | Lewis | |
| 4,667,890 | A | | 5/1987 | Gietman, Jr. | |
| 4,684,075 | A | | 8/1987 | Francis | |
| 4,690,345 | A | | 9/1987 | Cotey | |
| 4,721,264 | A | | 1/1988 | Muscarello | |
| 4,735,317 | A | | 4/1988 | Sussman et al. | |
| 4,756,485 | A | | 7/1988 | Bastian et al. | |
| 4,775,109 | A | | 10/1988 | Tegg | |
| 4,784,290 | A | | 11/1988 | Howard | |
| 4,790,490 | A | | 12/1988 | Chakravorty | |
| 4,804,149 | A | * | 2/1989 | Murphy | 242/598.3 |
| 4,807,823 | A | | 2/1989 | Wyant | |
| 4,826,063 | A | | 5/1989 | Ban | |
| 4,828,193 | A | | 5/1989 | Galbraith | |
| 4,830,301 | A | | 5/1989 | Miller | |
| 4,834,316 | A | | 5/1989 | DeLorean | |
| 4,836,368 | A | | 6/1989 | Cotton | |
| 4,836,462 | A | | 6/1989 | Bruss | |
| 4,846,412 | A | | 7/1989 | Morand | |
| 4,860,893 | A | | 8/1989 | Kaufman | |
| D303,890 | S | | 10/1989 | Pilot | |
| 4,877,133 | A | | 10/1989 | Klenter et al. | |
| 4,883,197 | A | | 11/1989 | Sanchez et al. | |
| 4,884,690 | A | | 12/1989 | Klenter et al. | |
| 4,890,205 | A | | 12/1989 | Shaffer | |
| 4,913,365 | A | | 4/1990 | Shamass | |
| 4,936,452 | A | | 6/1990 | Pauley | |
| D311,106 | S | | 10/1990 | Jaber | |
| 4,978,095 | A | | 12/1990 | Phillips | |
| 4,984,530 | A | | 1/1991 | Dutton | |
| 4,989,800 | A | | 2/1991 | Tritch | |
| 4,991,538 | A | | 2/1991 | Davids et al. | |
| 5,000,393 | A | | 3/1991 | Madsen | |
| 5,009,313 | A | | 4/1991 | Morand | |
| 5,012,986 | A | | 5/1991 | Needle | |
| 5,029,787 | A | | 7/1991 | Florentin | |
| 5,049,440 | A | | 9/1991 | Bornhoeft, III et al. | |
| 5,050,737 | A | | 9/1991 | Joslyn et al. | |
| 5,104,054 | A | | 4/1992 | Latham | |
| 5,137,173 | A | | 8/1992 | Hughes et al. | |
| 5,141,171 | A | | 8/1992 | Yang | |
| 5,145,091 | A | | 9/1992 | Meyers | |
| D329,978 | S | | 10/1992 | Ryan | |
| 5,154,496 | A | | 10/1992 | Campbell et al. | |

5,170,958 A 12/1992 Brown
5,172,840 A 12/1992 Bloch et al.
5,192,044 A 3/1993 Baskin
5,193,759 A 3/1993 Bigelow et al.
5,195,689 A 3/1993 Beer et al.
5,207,367 A 5/1993 Dunn et al.
5,219,092 A 6/1993 Morand
5,228,632 A 7/1993 Addison et al.
5,253,818 A 10/1993 Craddock
5,255,800 A 10/1993 Kelly
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
5,312,883 A 5/1994 Komatsu et al.
5,317,063 A 5/1994 Komatsu et al.
D347,534 S 6/1994 Gottselig
5,335,811 A 8/1994 Morand
5,368,157 A 11/1994 Gasparrini et al.
5,370,336 A 12/1994 Whittington
5,374,008 A 12/1994 Halvorson et al.
5,384,189 A 1/1995 Kuroda et al.
5,392,945 A 2/1995 Syrek
D356,707 S * 3/1995 Morand ..... D6/522
5,400,982 A 3/1995 Collins
5,409,181 A 4/1995 Patrick
5,439,521 A 8/1995 Rao
5,443,084 A 8/1995 Saleur
5,449,127 A 9/1995 Davis
D362,773 S 10/1995 Kartchner
5,456,420 A 10/1995 Frazier
5,456,421 A 10/1995 Reed
5,462,197 A 10/1995 Pound
5,464,096 A 11/1995 Hurwitz
5,464,170 A 11/1995 Mitchell et al.
5,480,060 A 1/1996 Blythe
5,494,250 A 2/1996 Chen
5,495,997 A 3/1996 Moody
5,501,323 A 3/1996 Denesha et al.
5,509,593 A 4/1996 Bloch et al.
5,520,308 A 5/1996 Berg, Jr. et al.
5,526,973 A 6/1996 Boone et al.
5,533,621 A 7/1996 Schoal, Jr.
5,540,332 A 7/1996 Kopacz et al.
5,542,568 A 8/1996 Julius
5,560,514 A 10/1996 Frazier
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,609,269 A 3/1997 Behnke et al.
5,618,008 A * 4/1997 Dearwester et al. ..... 242/594.5
5,620,148 A 4/1997 Mitchell
5,624,025 A 4/1997 Hixon
5,630,526 A 5/1997 Moody
5,630,563 A 5/1997 Meisner et al.
5,631,317 A 5/1997 Komatsu et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A 8/1997 Newbold
5,660,636 A 8/1997 Shangold et al.
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A 12/1997 Ogden
5,704,565 A 1/1998 Cheng
5,704,566 A 1/1998 Schutz et al.
5,765,717 A 6/1998 Gottselig
D397,265 S 8/1998 Badillo
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,875,985 A 3/1999 Cohen et al.
5,887,759 A 3/1999 Ayigbe
5,887,818 A 3/1999 Kelley
5,893,531 A 4/1999 Taylor et al.
5,897,074 A 4/1999 Marino
5,901,921 A 5/1999 Perlsweig
5,904,316 A 5/1999 Dunning et al.
5,914,177 A 6/1999 Smith, III et al.
5,924,617 A 7/1999 LaCount et al.
D412,439 S 8/1999 Cormack
5,938,013 A 8/1999 Palumbo et al.
5,950,960 A * 9/1999 Marino ..... 242/594.5
5,951,762 A 9/1999 Shangold et al.
5,958,187 A 9/1999 Bhat et al.
5,964,351 A 10/1999 Zander
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
5,992,718 A 11/1999 Zaranck
D417,987 S * 12/1999 Velazquez ..... D6/520
6,000,538 A 12/1999 Lee
6,000,658 A 12/1999 McCall, Jr.
6,007,019 A 12/1999 Lynch
6,010,001 A 1/2000 Osborn, III
6,015,125 A 1/2000 Fischer
6,024,216 A 2/2000 Shillington et al.
6,024,217 A 2/2000 Ponse et al.
6,024,323 A 2/2000 Palerno, Jr.
D421,690 S * 3/2000 Sutherland ..... D6/520
D421,691 S 3/2000 Hoblitz
6,036,134 A 3/2000 Moody
D422,437 S 4/2000 Conran et al.
6,047,920 A 4/2000 Dearwester et al.
6,056,233 A * 5/2000 Von Schenk ..... 242/594.5
6,056,235 A 5/2000 Brozinsky
6,059,882 A 5/2000 Steinhardt et al.
6,059,928 A 5/2000 Van Luu et al.
6,068,118 A 5/2000 Calloway
6,070,821 A 6/2000 Mitchell
6,079,603 A 6/2000 Smegal
6,082,664 A 7/2000 Phelps et al.
6,085,899 A 7/2000 Thorsbakken
6,092,690 A 7/2000 Bitowft et al.
6,092,758 A 7/2000 Gemmell
6,092,759 A * 7/2000 Gemmell et al. ..... 242/596.8
D429,282 S 8/2000 Velazquez et al.
6,098,836 A 8/2000 Gottselig
6,121,165 A 9/2000 Mackey et al.
6,138,939 A 10/2000 Phelps et al.
6,158,614 A 12/2000 Haines et al.
D441,231 S * 5/2001 Purcell et al. ..... D6/522
D451,728 S * 12/2001 Phelps et al. ..... D6/522
D457,765 S 5/2002 Peotter et al.

| | | | | | |
|---|---|---|---|---|---|
| D457,766 | S | * | 5/2002 | Omdoll et al. | D6/523 |
| 6,382,552 | B1 | * | 5/2002 | Paul et al. | 242/595 |
| 6,412,726 | B2 | * | 7/2002 | Inana et al. | 126/200 |
| 6,423,804 | B1 | | 7/2002 | Chang et al. | |
| 6,429,261 | B1 | | 8/2002 | Lang et al. | |
| D462,215 | S | | 9/2002 | Bartelt et al. | |
| 6,444,214 | B1 | | 9/2002 | Cole et al. | |
| 2001/0039786 | A1 | | 11/2001 | Romme et al. | |
| 2002/0005452 | A1 | | 1/2002 | Romme et al. | |
| 2002/0036208 | A1 | | 3/2002 | Faulks et al. | |
| 2002/0056785 | A1 | | 5/2002 | Newman et al. | |
| 2003/0019974 | A1 | | 1/2003 | Faulks et al. | |

OTHER PUBLICATIONS

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand."

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder."

Kotler, Philip, *Marketing Management*, Prentice Hall, Upper Saddle River, NJ, 2000, p. 456–483.

PCT search report for application Ser. No.: PCT/US00/11284, dated Jul. 28, 2000.

Images of Moist Mates product—dispenser and wipes, approximately 1996.

Images of Moist Mates product—dispenser, approximately 2000.

Images of Moist Mates product—refill wipes, approximately 2000.

Search Report for Patent Cooperation Treaty application No. PCT/US 01/11195, Date of Mailing Jul. 19, 2001, 7 pages.

Search Report for Patent Cooperation Treaty application No. PCT/US 01/11198, Date of Mailing Jul. 19, 2001, 7 pages.

Search Report for Patent Cooperation Treaty application No. PCT/US 01/11620, Date of Mailing Jul. 19, 2001, 7 pages.

Search Report for Patent Cooperation Treaty application No. PCT/US 01/11686, Date of Mailing Jul. 11, 2001, 5 pages.

Search Report for Patent Cooperation Treaty application No. PCT/US 01/11131, Date of Mailing Jul. 23, 2001, 7 pages.

Search Report for Patent Cooperation Treaty application No. PCT/US 01/11447, Date of Mailing Jul. 19, 2001, 6 pages.

Search Report for Patent Cooperation Treaty application No. PCT/US 01/11467, Date of Mailing Jul. 19, 2001, 7 pages.

Search Report for Patent Cooperation Treaty application No. PCT/US 01/12091, Date of Mailing Jul. 9, 2001, 4 pages.

Search Report for Patent Cooperation Treaty application No. PCT/US 01/14113, Date of Mailing Jul. 19, 2001, 6 pages.

Search Report for Patent Cooperation Treaty application No. PCT/US 01/40677, Date of Mailing Jul. 19, 2001, 6 pages.

Letter, dated Apr. 4, 1998, and accompanying drawings.

Invitation to Pay Additional Fees for Patent Cooperation Treaty application No. PCT/US 01/27698, Date of Mailing Jan. 10, 2002, 7 pages.

Search Report for Patent Cooperation Treaty application No. PCT/US 01/28520, Date of Mailing Mar. 4, 2002, 7 pages.

Search Report for Patent Cooperation Treaty application No. PCT/US01/27698, Date of Mailing Apr. 5, 2002, 4 pages.

* cited by examiner

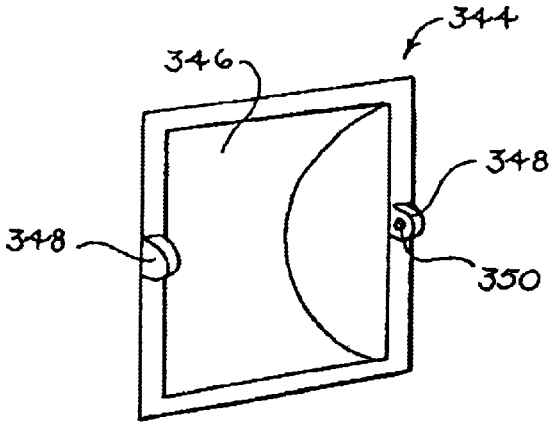
Fig. 15
CONVENTIONAL
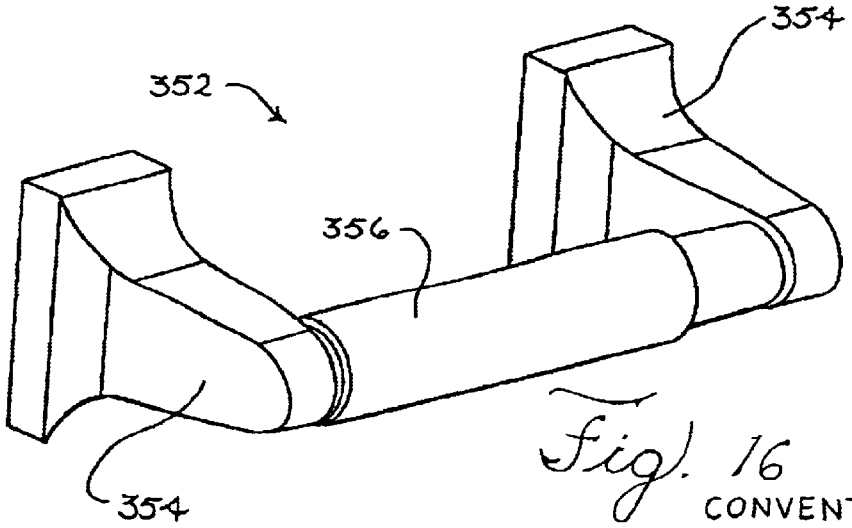
Fig. 16
CONVENTIONAL

DISPENSER FOR PREMOISTENED WIPES

This application is a continuation of pending U.S. application Ser. No. 09/545,995, which was filed on Apr. 10, 2000, and which claims the benefit of the filing date pursuant to 35 U.S.C. §119(e) of, Provisional Application Serial No. 60/132,024, filed Apr. 30, 1999, for a dispenser for premoistened wipes, the disclosures of which are hereby incorporated by reference.

BACKGROUND OF THE INVENTION

The present invention relates to dispensers and, more specifically, to a dispenser for both premoistened wipes and dry bathroom tissue.

The use of premoistened wipes is well known. Such premoistened wipes are commonly used with small children and infants when replacing soiled diapers. Premoistened wipes are also used to provide a convenient and effective cleaning material in the absence of running water. Premoistened wipes are also used as a replacement for, or supplement to, dry bathroom tissue.

Premoistened wipes may be supplied in individual packages or supplied in larger quantities. While individually supplied wet wipes are typically provided in disposable packaging, larger quantities of wipes may be supplied in either disposable or re-useable containers. Two common containers for supplying multiple wipes are resealable bags and tubs. The resealable bags often have a "zippered" opening which has a pair of interlocking profiles which may be re-engaged to seal the bag after removing one or more wipes from the bag. Tubs are also common and often have a lid which allows access to a stack of folded wipes when the lid is in an open position.

SUMMARY OF THE INVENTION

In one aspect, the present invention provides a dispenser for premoistened wipes and dry tissue mountable on a conventional bathroom tissue fixture which comprises, i.e., includes but is not limited to, a compact housing having a first compartment, and a second compartment. The first compartment defines a substantially enclosed interior space in which the premoistened wipes may be positioned and the second compartment includes a support bar for dry tissue. The housing may also include at least one substantially horizontal engagement surface. A mounting device which supportingly engages the engagement surface and has a first support and a second support may also be included with the dispenser. The first and second supports define a lateral axis and are projectable outwardly from opposite sides of the dispenser for engagement with the fixture. The mounting device is adjustably attachable to the dispenser whereby the mounting device engages a selective portion of the engagement surface and the lateral axis is selectively positionable relative to the dispenser housing.

A compact dispenser may be provided by placing one compartment above the mounting device and the other compartment below the mounting device. By utilizing compartments which generally define a relatively larger volume nearest the mounting device and define a relatively smaller volume near the upper and lower edges of the dispenser, the compactness of such a dispenser may be enhanced. A generally curvilinear front surface may be used with such a dispenser.

Such a dispenser may have a first compartment which further includes a first horizontally extending panel and a second compartment which includes a second horizontally extending panel, said first and second horizontally extending panels relatively disposed in spaced and substantially parallel positions and defining a slot therebetween for slidably receiving the mounting device. The engagement surface may be located on one of the horizontally extending panels and the slot may have first and second openings on opposite lateral sides of the dispenser through which the first and second supports may project outwardly.

The mounting device may be laterally and slidably engaged with the housing whereby the mounting device is slidable in a direction which is substantially perpendicular to the lateral axis defined by the first and second supports. Such a mounting device may be positioned between the first and second compartments and laterally engage a panel defining a portion of one of said panels.

The mounting device may also be slidably positioned between the first and second horizontally extending panels and laterally engage each of the horizontally extending panels. Such a mounting device may include a first projection for engaging a first recess in the first horizontally extending panel and a second projection for engaging a second recess in the second horizontally extending panel.

The dispenser may also include a tray having a support surface for the premoistened wipes wherein the tray is removably positioned in the interior space of the first compartment. The first compartment may also include a cover having open and closed positions.

In another aspect, the present invention provides a dispenser for premoistened wipes and dry tissue mountable on a conventional bathroom tissue fixture which includes a housing having a first compartment and a second compartment. The first compartment includes a first plurality of connected panels which includes a first horizontally extending panel and wherein the premoistened wipes are positionable within the first compartment. The second compartment includes a second plurality of connected panels which includes a second horizontally extending panel. The second compartment also includes a support bar for the dry tissue wherein the support bar is attachable to at least one of the second plurality of panels. A mounting device is adjustably positioned between the first and second horizontally extending panels and includes first and second supports. The first and second supports define a lateral axis and are projectable outwardly from opposite sides of the dispenser for engagement with the fixture.

In yet another aspect, the present invention provides a dispenser for premoistened wipes and dry tissue which is mountable on a conventional bathroom tissue fixture. The dispenser includes a first compartment having a cover and defining a substantially enclosed interior space. A tray having a support surface for the premoistened wipes is removably positioned within the interior space of the first compartment. A support bar for the dry tissue is attachable to the dispenser. The dispenser also includes a mounting device having first and second supports. The first and second supports define a lateral axis and are projectable outwardly from opposite sides of the dispenser for engagement with the fixture. The mounting device being adjustably positionable relative to the first compartment.

In a still further aspect, the present invention provides a dispenser for premoistened wipes and dry tissue which includes a housing having a first compartment and a second compartment. The first compartment includes a cover panel cooperatively engageable with a first plurality of panels whereby the cover and first plurality of panels define a substantially enclosed interior space when the cover is in a closed position. The premoistened wipes are positionable within the interior space of the first compartment. The second compartment includes a pair of side panels which have a pair of oppositely disposed recesses for supporting a roll bar which may, in turn, support a roll of conventional dry bathroom tissue. The dispenser also includes a pair of pivot arms attached to the cover panel. The pivot arms are pivotally connected to the dispenser whereby the cover panel is moveable between a closed position and an open position. The pivot axis of the pivot arms is aligned with the oppositely disposed recesses for supporting the roll bar.

One advantage provided by the present invention is that it provides a dispenser for both premoistened wipes and dry tissue which may be conveniently attached to a conventional bathroom tissue fixture. Moreover, those embodiments of the present invention which include an adjustably positionable mounting device may be easily mounted to a wide variety of different conventional bathroom tissue fixtures.

Yet another advantage of the present invention is that it provides a compact dispenser capable of dispensing either or both premoistened wipes and conventional dry bathroom tissue. These and other advantages of the invention are provided by its various aspects, individually and in combinations thereof.

BRIEF DESCRIPTION OF THE DRAWINGS

The invention will be more fully understood and further advantages will become apparent when reference is made to the following description of the invention and the accompanying drawings, in which:

FIG. 15 is a perspective view of a conventional bathroom tissue fixture;

FIG. 16 is a perspective view of another conventional bathroom tissue fixture;

Figure 1:
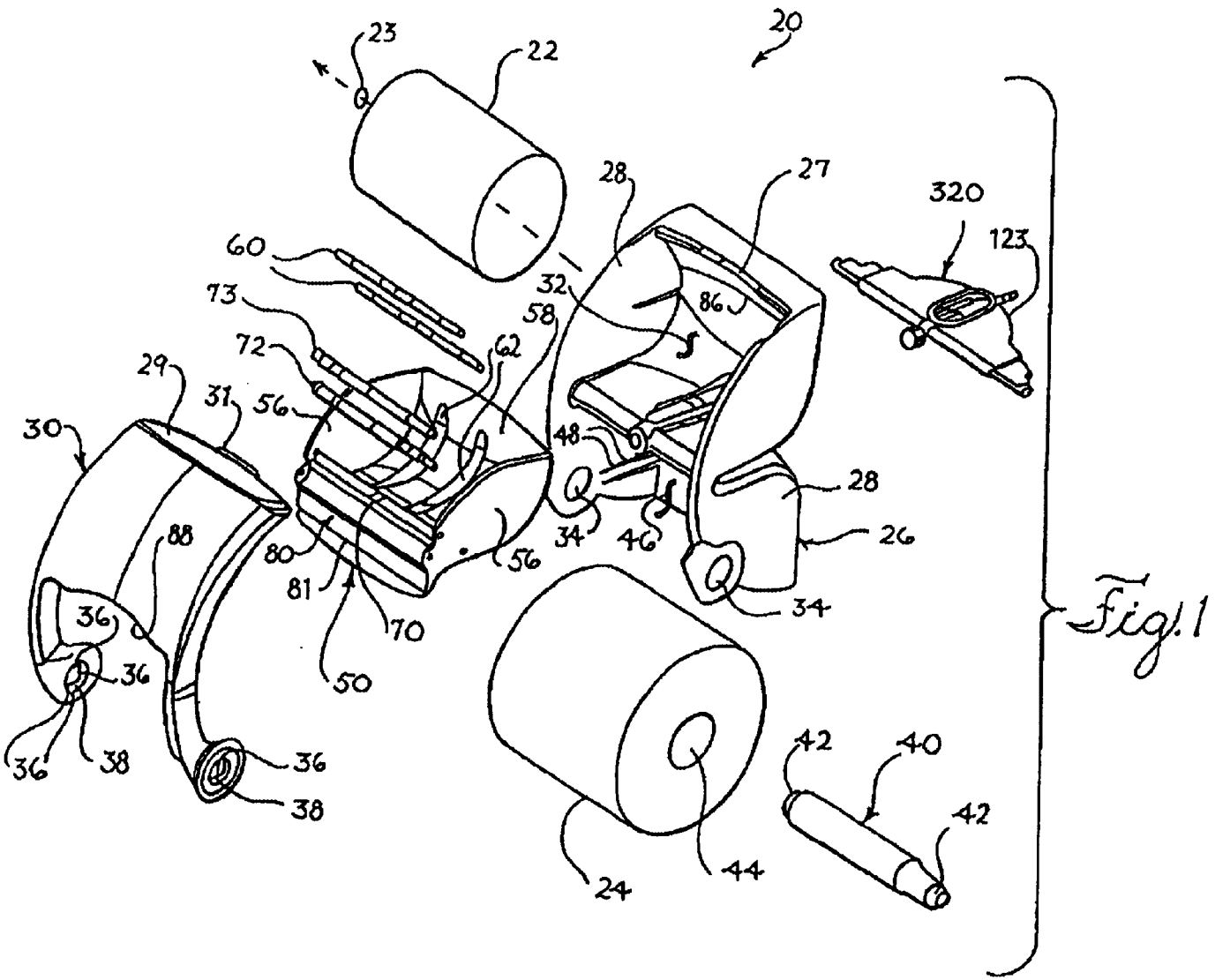
FIG. 1 is an exploded view of a compact dispenser in accordance with the present invention.

Corresponding reference characters indicate corresponding parts throughout the several views. The disclosed embodiments are set forth to illustrate and exemplify the invention. The disclosed embodiments are not intended to be an exhaustive illustration of the invention or to be construed as limiting the scope of the invention to the precise forms disclosed.

DESCRIPTION OF THE INVENTION

Figure 2:
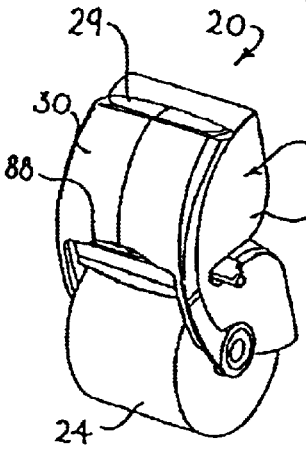
FIG. 2 is a perspective view of the dispenser of FIG. 1.

FIG. 1 illustrates one representative embodiment of the present invention in an exploded view. As can be seen in FIG. 1, the illustrated dispenser 20 can be used to provide either or both premoistened wipes 22 and conventional dry bathroom tissues 24. The illustrated dispenser has a housing 26 with a frame 28 and a cover 30. Together the frame 28 and cover 30 enclose and define a first compartment having an interior space 32 when the cover is in a closed position as shown in FIG. 2. The cover 30 is shown in an open position in FIGS. 9 and 10.

The cover 30 is attached to the frame 28 at two circular apertures 34 in the frame 28. The cover 30 includes a plurality of projections 36 which are inserted inwardly through the apertures 34 to rotatably mount the cover 30 to the frame 28. The projections 36 provide a bearing surface for engagement with the interior surface of the apertures 34 whereby the cover 30 may be rotated between an open position and a closed position. Some or all of the projections 36 may include outwardly extending tangs at their distal ends which engage the inner surface of the frame 28 adjacent the apertures 34 and thereby inhibit the disengagement of the cover 30 and the frame 28.

The radially inward surfaces 38 of the projections 36 define an opening which is configured to receive the recessed end portions 42 of a telescoping roll bar 40. Telescoping roll bar 40 provides a support which is insertable into the hollow core 44 of a roll of dry bathroom tissue 24 in a conventional manner. The illustrated roll bar 40 has a female member which extends for approximately ¾ of the total length of the support to prevent the bar from tilting. The male and female members of the roll bar 40 remain assembled when removed from the dispenser 20 and include an internal spring selected to have a force which does not distort the housing frame 28. The ends of the roll bar 40 define a curved surface to provide an outward button-like appearance to the ends of the roll bar 40 and facilitate the removal of the roll bar 40. The telescoping members of the roll bar 40 may be advantageously made of the same materials as the frame 28 and have a matching color.

Alternative supports which are insertable into the hollow core 44 of a rolled tissue product 24 and allow the rotation of the rolled tissue 24 thereon, such as alternative telescoping roll bars, a freely extending cylindrical or J-shaped projection, are also well known and may be combined with the housing 26 to provide for the dispensing of a dry rolled tissue product.

The illustrated frame 28 includes a second compartment defining a lower space 46 in which a portion of the dry bathroom tissue 24 is located after the dry tissue 24 is mounted on the roll bar 40. As can be seen in FIG. 1, the frame 28 may also include reinforcing ribs 48 which both provide strength to the frame 28 and help the user of the dispenser 20 to locate the apertures 34 when installing the roll bar 40.

The illustrated cover 30 also includes a recessed portion 29 which allows the cover to be easily grasped when opening the cover 30. Adjacent the recessed portion 29, a latching projection 31 extends from the cover and is received by recess 27 located in the frame 28. The latching projection 31 may engage the recess 27 with an interference or snap fit relationship whereby the engagement of the latching projection 31 with the recess 27 maintains the cover 30 in a closed position. Downward pressure on recessed portion 29 disengages the projection 31 and recess 27 to allow the cover 30 to be opened. The recessed portion 29 may advantageously employ a different surface texture or color adjacent the latching projection 31 to indicate where pressure should be applied to open the cover 30. The illustrated recess 27 is positioned to be generally hidden from view when the cover 30 is in a closed position. A large variety of different methods and mechanisms for retaining a cover to a frame are known and may be substituted for the illustrated latching method.

The cover 30 may be advantageously formed out of material which permits a user of the dispenser to determine the amount of premoistened wipes remaining in the interior space 32 without opening the cover 30. Alternatively, a small portion of the cover 30 may be clear or partially clear to permit an external visual determination of the amount of premoistened wipes 22 which remain in the interior space 32. The cover 30 may be advantageously formed by an injection molding process using a polycarbonate material.

The illustrated dispenser 20 also includes a removable tray 50. When positioned in the dispenser 20, the tray 50 defines the lower boundary of the interior space 32 in which the premoistened wipes 22 are placed. The tray 50 may be removed by merely opening the cover 30 without dismounting the frame 28.

The tray and other dispenser components may be advantageously formed by an injection molding process using an acrylonitrile butadiene styrene (ABS), polycarbonate, polypropylene, polyethylene, acetal or other suitable material. Those having ordinary skill in the art will recognize that these parts may be formed using a variety of alternative known materials and manufacturing techniques, e.g., machining.

As best seen in FIG. 1, the premoistened wipes placed in the tray 50 may be a coreless roll of premoistened wipes 22 having an axis 23. The premoistened wipes 22 advantageously have perforations (not illustrated) extending parallel to the axis and separating individual sheets of the rolled premoistened material to enable one or more sheets of the material to be conveniently separated from the remainder of the roll in a manner similar to that commonly employed with conventional dry bathroom tissue. The absence of a hollow core allows more wipes to be provided for a given roll diameter and eliminates the need for a disposable core. Alternative forms of premoistened wipes may also be used with a dispenser having a removable tray. For example, a stack of flat or folded individual or interconnected wipes or a roll of wipes having a core may be used.

To load the tray with wipes, the premoistened wipes are positioned above the lower surface and inward of the walls 56, 58. The wipes are conveniently placed into the tray 50 after first removing the tray 50 from the frame 28. Once the wipes have been placed in the tray 50 and the leading wipe draped over dispensing guide 73, the tray 50 and wipes 22 are then inserted into the interior space 32 as a single unit. Alternatively, the wipes 22 may be placed in the tray 50 while the tray is within the interior space 32.

After inserting the tray 50 and wipes 22, the cover 30 is closed whereby the leading wipe is engaged between the dispensing guide 73 located on the tray and the dispensing guide 72 located on the cover 30.

Figure 9:
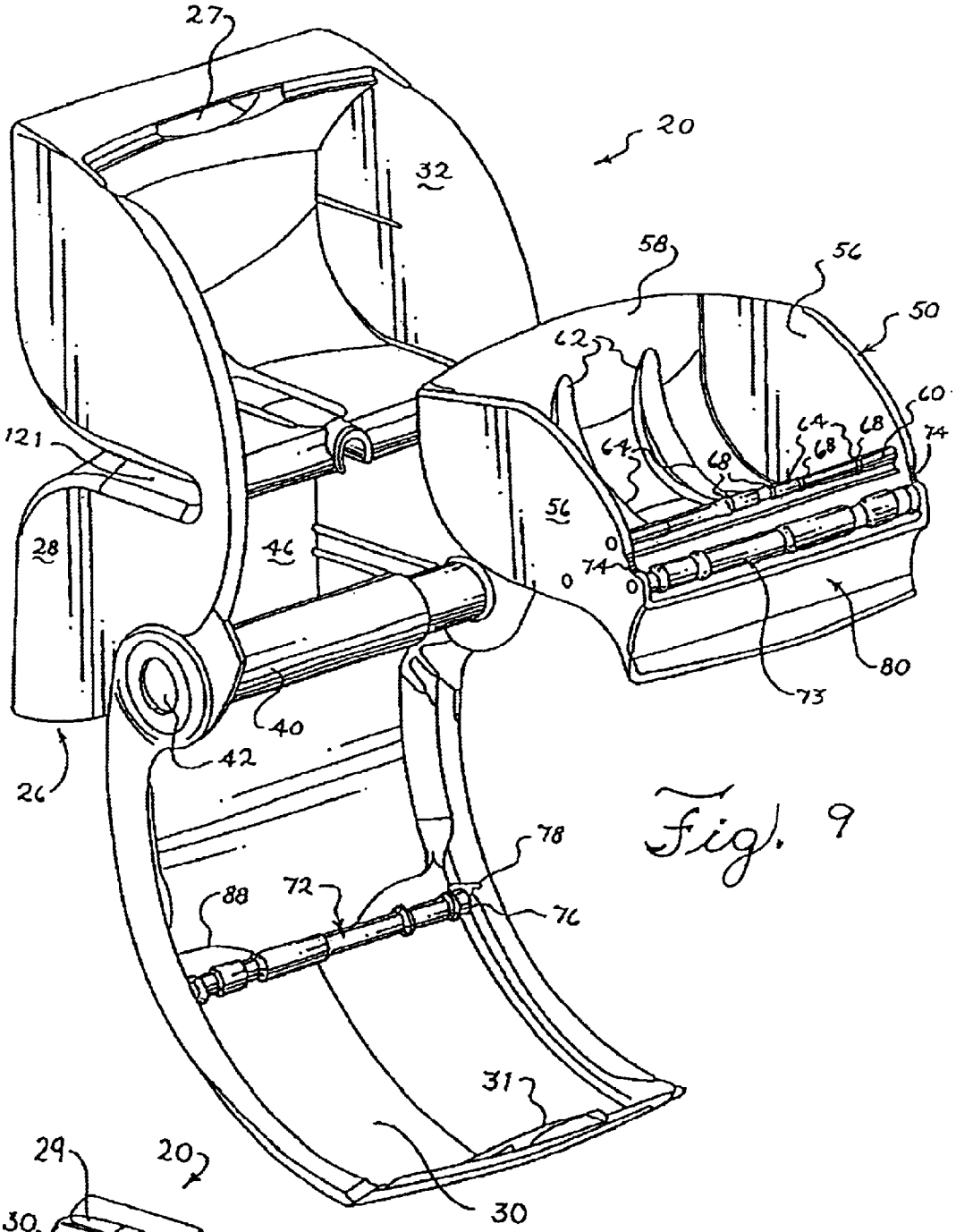
FIG. 9 is an exploded view of a tray and dispenser housing.

To ensure the proper positioning of the two dispensing guides 72, 73 when the cover 30 is placed in a closed position, the tray has a pair of engagement surfaces 74 located near the opposite lateral ends of the dispensing guide 73. The engagement surfaces 74 located on the tray 50 are engaged by a second pair of engagement surfaces 76 located on the cover 30 near the opposite lateral ends of the dispensing guide 72 (FIG. 9).

In addition to the engagement surfaces 74, 76 which are located above the dispensing guide 73, the cover 30 and tray 50 also include another set of engagement surfaces on the opposite, lower side of the dispensing guide 73. These additional engagement surfaces are provided on a grip 80 located on the tray 50 and by projections 82 located on the cover 30. The grip 80 defines a laterally extending arcuate surface 81 which is engageable at its lateral ends by the projections 82. The arcuate grip surface 81 and projections 82 thereby contribute to the proper alignment of the cover 30 and the tray 50 and the dispenser guides 72, 73 located thereon.

The grip 80 is positioned so that it may be grasped when inserting or removing the tray 50 from the dispenser 20. The illustrated grip 80 not only provides a thin, easily gripped projection but the portion of the illustrated grip 80 which forms the exterior surface 81 which is visible when the dispenser is in a closed position also contributes to the aesthetic outward appearance of the dispenser 20 and conceals the threaded fastener 338.

After inserting the tray 50 and wipes 22 into the dispenser, the wipes may be dispensed by pulling the leading wipe and separating a length of premoistened wipes from the remainder of the roll 22 by tearing the wipe material along a row of perforations separating the individual wipes. The removal of the wipes leaves a new leading wipe engaged between the dispenser guides 72, 73. The dispensing process may be repeated until the supply of wipes in the tray is depleted whereupon the tray 50 may be removed from the dispenser 20 and the wipes replenished.

Figure 8:
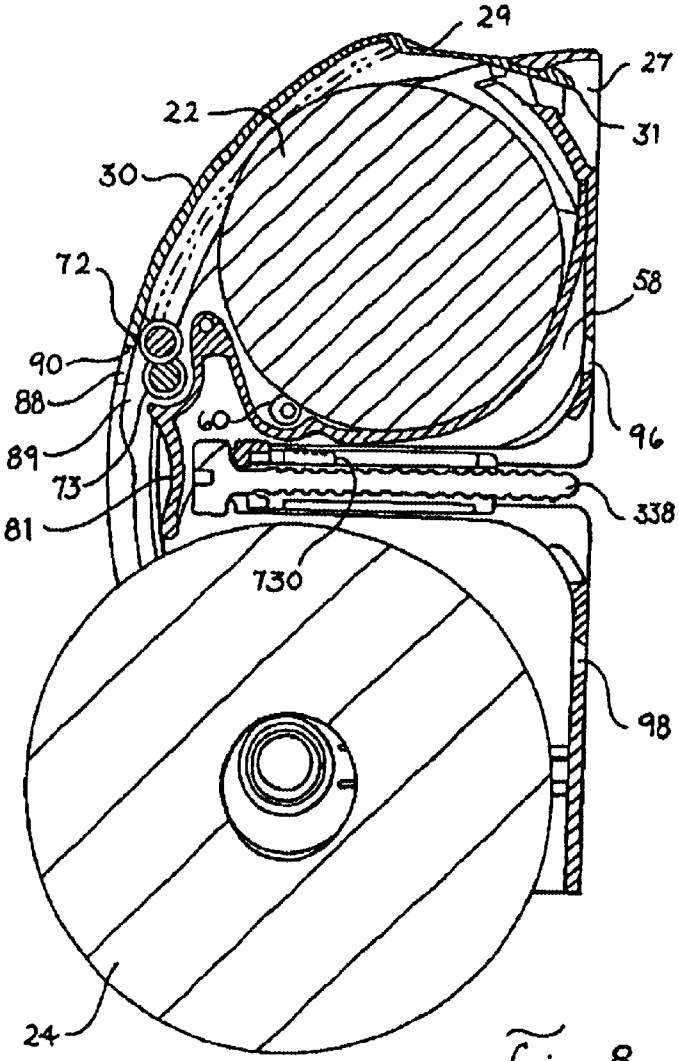
FIG. 8 is a cross sectional view taken along line 8—8 of FIG. 4.
Figure 7:
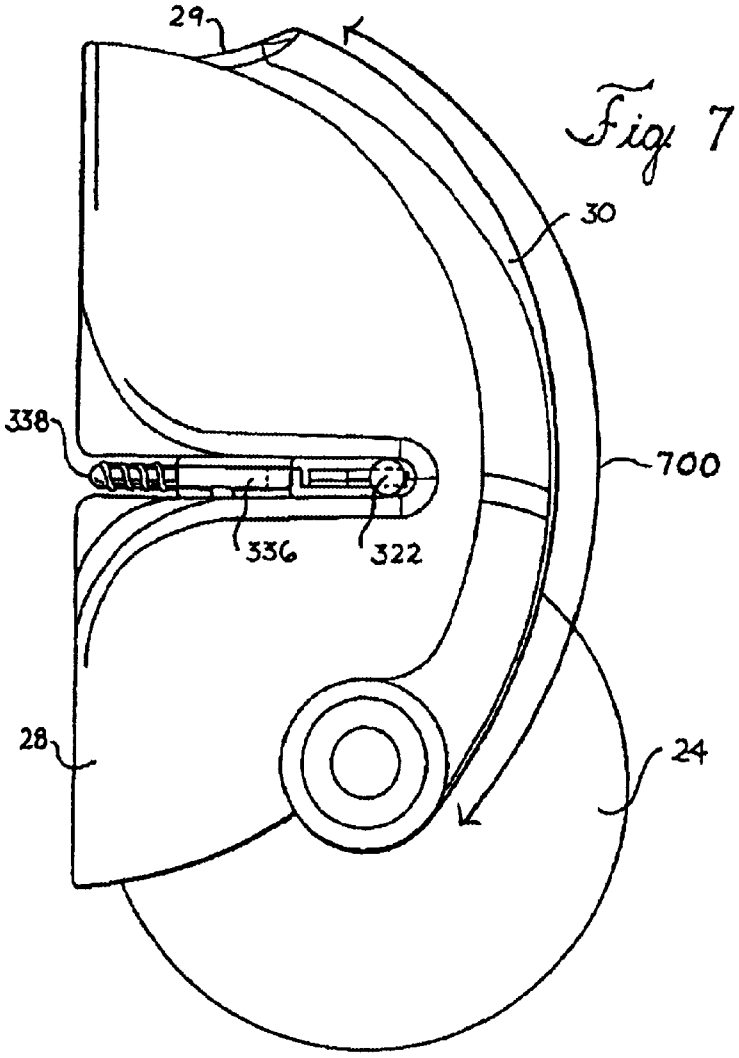
FIG. 7 is a side view of the dispenser of FIG. 3.

A dispenser 21 which does not include projections 82 for engaging grip 80 is illustrated in FIGS. 3–8. FIG. 8 presents a cross sectional view taken along line 8—8 of FIG. 4 and illustrates the relationship between the dispensing guides 72, 73 and the impingement surface 88 of the representative embodiment. The impingement surface 88 is formed by an edge of the cover 30 and defines an edge of a dispensing opening 89.

In addition to facilitating the separation of the dispensed wipes, the engagement of a wipe by the outer portions 92 of the impingement surface 88 may also produce a drag on the wipe during the dispensing process. The central portion 90 of the impingement surface 88 may also engage and produce a drag on the wipe. Depending upon the angle at which the wipe is pulled during dispensing, however, the premoistened wipes may not engage the central portion 90 of the impingement surface 88 during the dispensing process.

Figure 14:
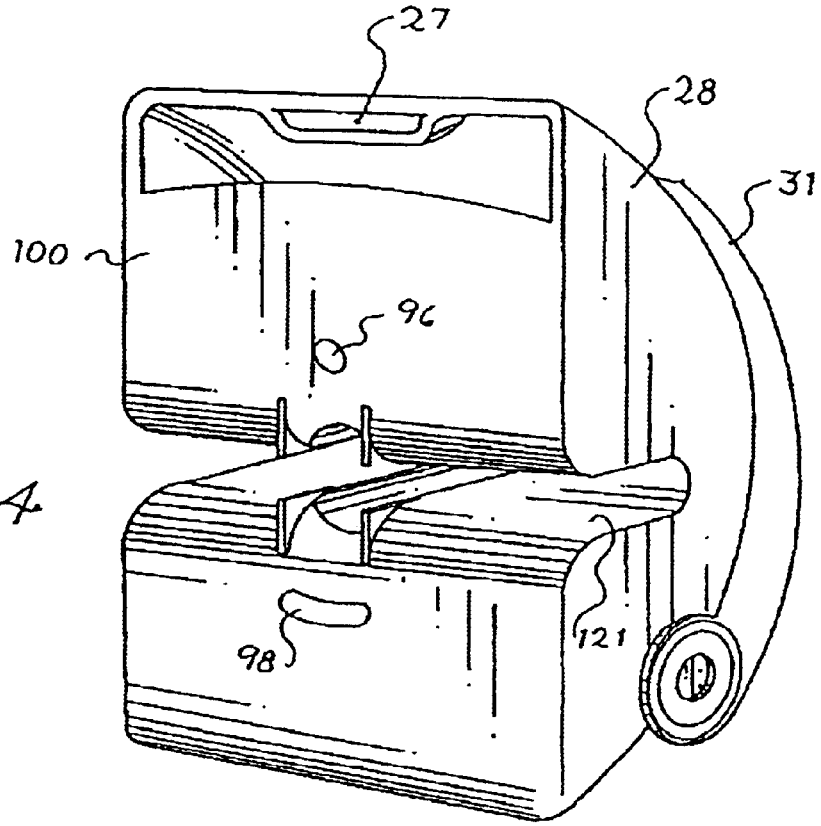
FIG. 14 is a perspective view of the rear of the dispenser of FIG. 2.

The dispenser may also be directly mounted to a wall, cabinet panel or similar support by inserting fasteners through apertures located in the rear surface of the frame 28. The apertures in the rear surface 100 of the frame 28 may include a round aperture 96 adapted to receive a threaded fastener therethrough. The aperture 96 may be advantageously positioned to correspond with the middle rib 62 of the tray whereby the void space defined by the rear of the middle rib 62 will overlay the head of the installed fastener to reduce the possibility of clearance difficulties between the fastener head and the tray. The rear surface of the frame 28 may also include another aperture 98 located below the above-described round aperture as shown in FIG. 14.

Alternatively, a mounting device 320 may be used to support the dispenser 20 on a conventional bathroom tissue fixture having a pair of opposed recesses for receiving a telescoping roll bar. A suitable mounting device is described in detail in commonly assigned U.S. Pat. No. 6,279,865 B1 entitled "Mounting Device", the disclosure of which is hereby incorporated by reference.

The mounting device 320 fits within a slot 121 in the frame 28 and is secured to the frame 28 with fastener 338. To accommodate a wide variety of conventional fixtures, the mounting device 320 can be secured at different positions along slot 121. For recessed fixtures, the mounting device 320 can be turned so that the curved end 123 of the mounting device 320 is inserted first into the slot 121 and the support arms 322, 324 can be located behind the rear surface 100 of the dispenser 20. Alternative mounting devices for attaching the dispenser 20 to a conventional bathroom tissue fixture may also be employed.

The mounting device 320 may be used with conventional bathroom tissue fixtures which are commonly found in residential and commercial buildings. FIGS. 15 and 16 show two examples of such conventional bathroom tissue fixtures. The fixture 344 illustrated in FIG. 15 has a recessed portion 346 and two short extensions 348 having a pair of oppositely disposed recesses 350 (only one is visible in FIG. 15) which may receive the ends of a conventional roll bar. The conventional fixture 352 shown in FIG. 16 includes two posts 354 which also include a pair of oppositely disposed recesses (not visible) for receiving the ends of a conventional telescoping roll bar 356.

Figure 17:
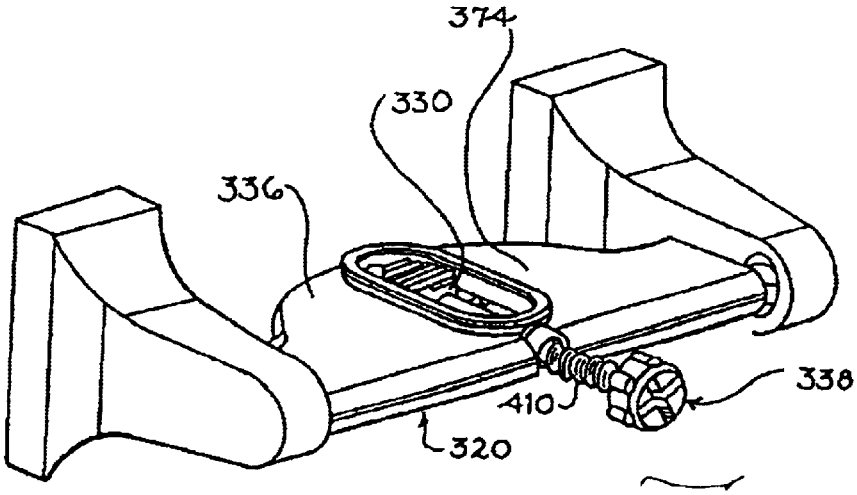
FIG. 17 is a perspective view of a mounting device engaged with a conventional bathroom tissue fixture.

FIG. 17 illustrates a mounting device 320 with the distal ends of its support members engaged with the oppositely disposed recesses of a conventional bathroom tissue fixture.

In the illustrated embodiment of mounting device 320, both support members 322 and 324 move relative to housing 336. In alternative embodiments, however, one of the support members could be affixed to the housing or formed integrally with the housing whereby only one of the support members would move relative to the housing. In such an embodiment, movement of the one support member would still result in relative movement between the two support members and the distal ends could be engaged and disengaged with a pair of oppositely disposed recesses.

The support arms 322, 324 and positioning member 330 may be formed as a single integral unit. The support arms 322, 324 and positioning member 330 may be advantageously formed by injection molding a polypropylene or acrylonitrile butadiene styrene (ABS) material. The housing 336 and threaded fastener may also be formed by injection molding a polypropylene or ABS material. Polycarbonate, polyethylene, acetal and other suitable materials may also be used. Those having ordinary skill in the art will recognize that these parts may be formed using a variety of alternative known materials and manufacturing techniques, e.g., machining.

Suitable dispensers for use with the mounting devices of the present invention include dispensers adapted to provide both dry and premoistened wiping products. Examples of such dispensers are described in detail in commonly assigned U.S. patent application Ser. No. 09/302,282 entitled "Dispenser and Tray for Premoistened Wipes" filed Apr. 30, 1999, and in U.S. Pat. No. 6,273,359 B1, entitled "Dispensing System and Method for Premoistened Wipes", the disclosures of which are hereby incorporated by reference.

Figure 11:
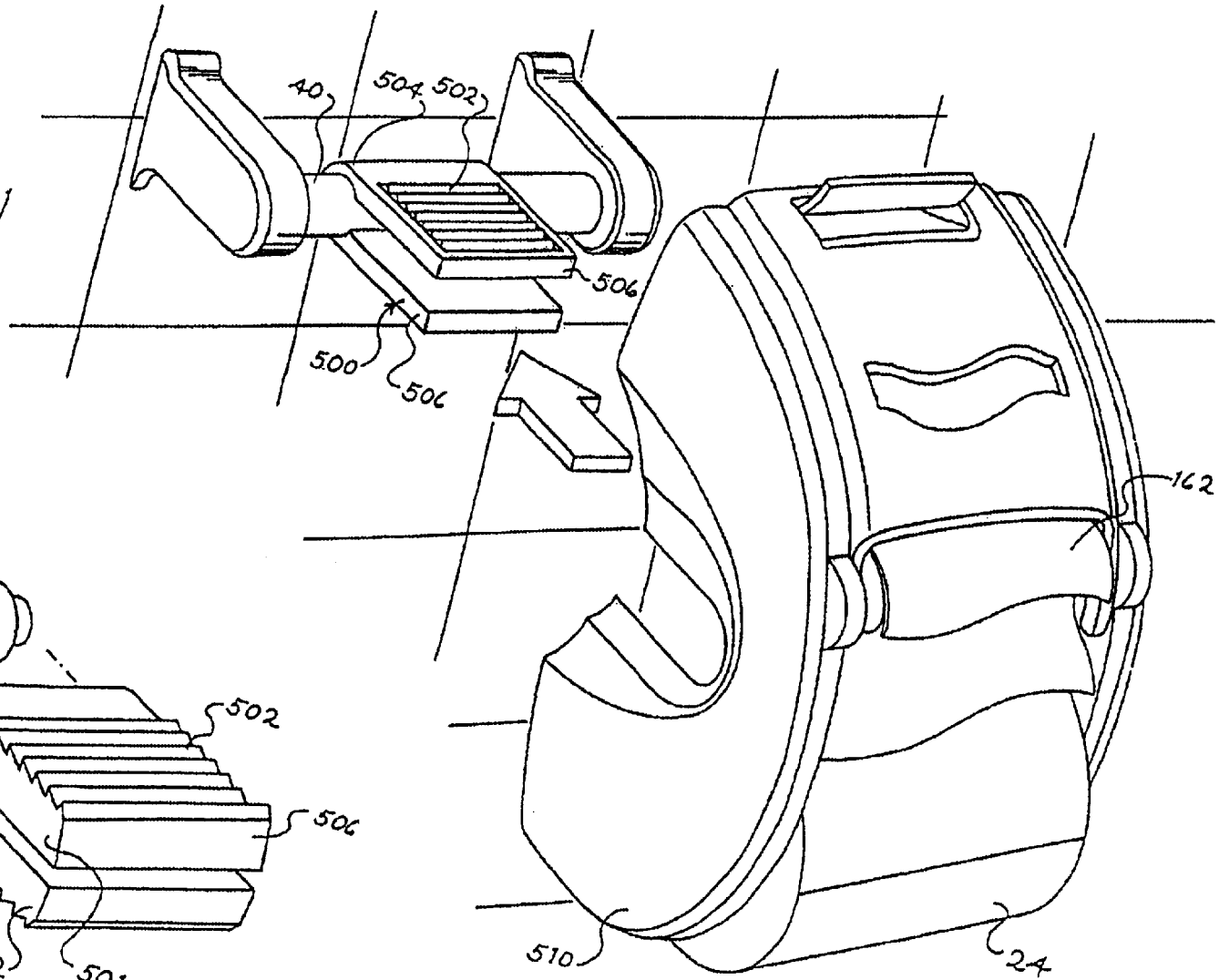
FIG. 11 is a perspective view of an alternative dispenser and mounting device.
Figure 12:
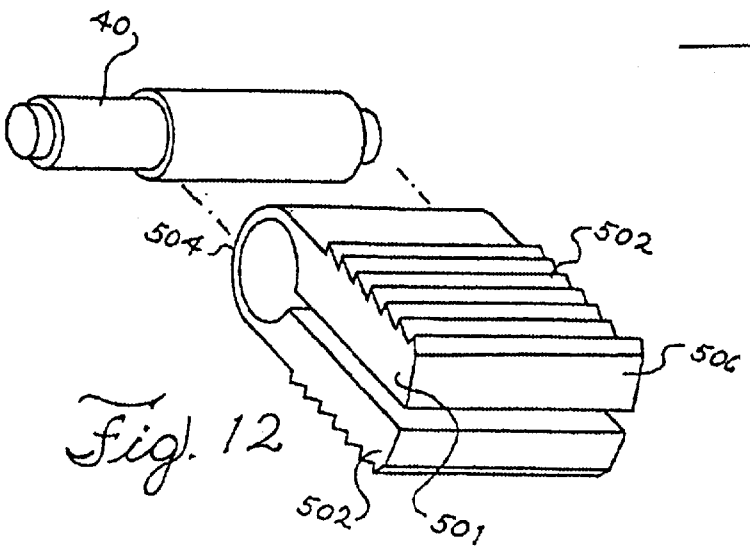
FIG. 12 is a perspective view of a roll bar and mounting device.
Figure 13:
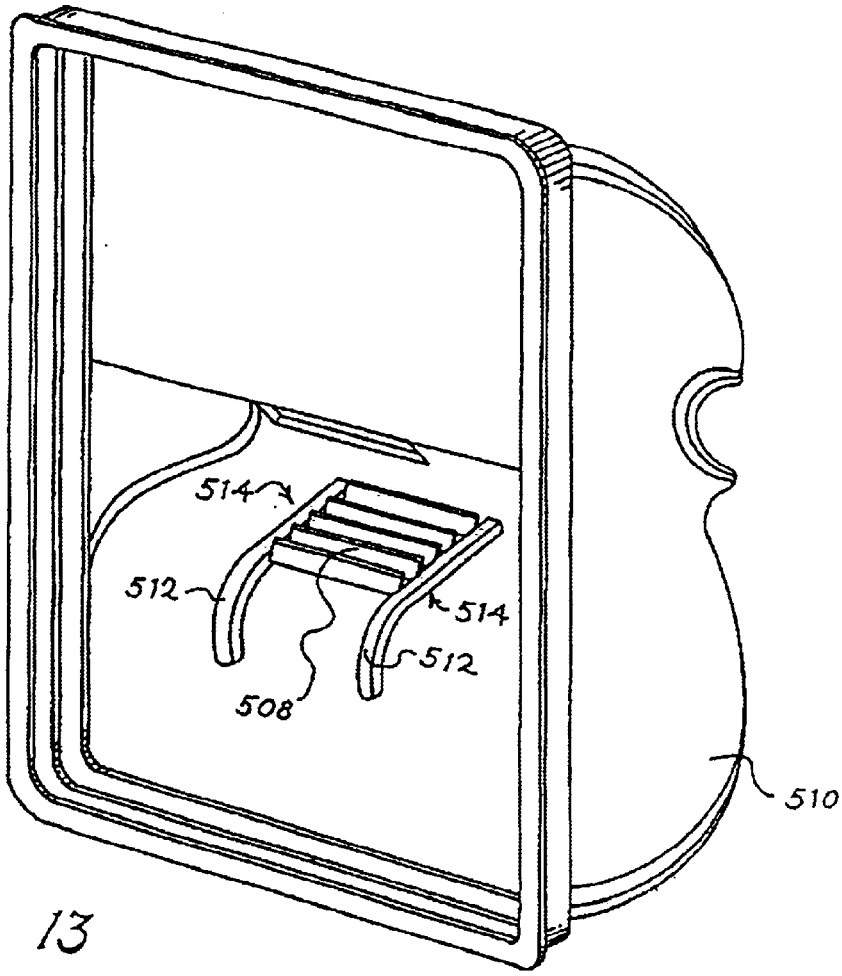
FIG. 13 is a rear perspective view of a dispenser.

An alternative mounting device 500 and dispenser 510 are shown in FIG. 11. The mounting device 500 is substantially U-shaped and is fitted onto a conventional roll bar 40 and may include one or more ratchet teeth 502. A similar mounting device 501 is illustrated in FIG. 12. The mounting devices 500, 501 may include a flexible portion 504 which allows the mounting devices 500, 501 to be hingably openable to receive the roll bar 40 by flexing arms 506 apart from each other. One or both arms 506 may include ratchet teeth 502 for engaging a dispenser 510. As can be seen in FIG. 13, the dispenser 510 may include an engagement mechanism 514 for engaging mounting devices 500, 501. The mechanism 514 includes one or more ratchet teeth 508 for engaging the ratchet teeth 502 of the mounting devices 500, 501. If flexible arms 512 are used with the mechanism 514, the ratchet teeth 508 and 502 may be readily disengaged by biasing the engagement mechanism 514 out of engagement with the mounting device 500, 501. One or more engagement mechanisms 514 may be used to engage mounting devices 500, 501.

Figure 18:
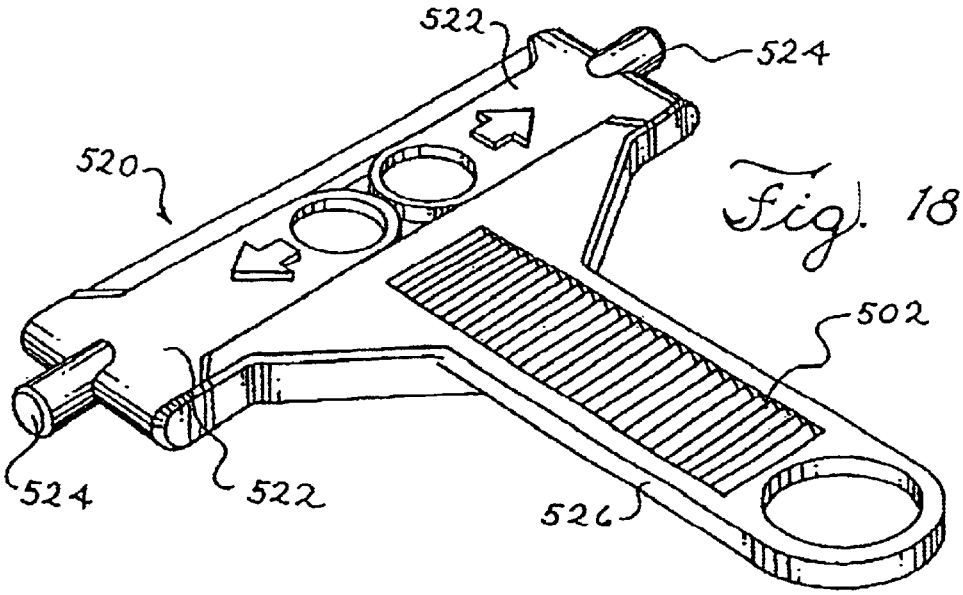
FIG. 18 is a perspective view of a mounting device.
Figure 19:
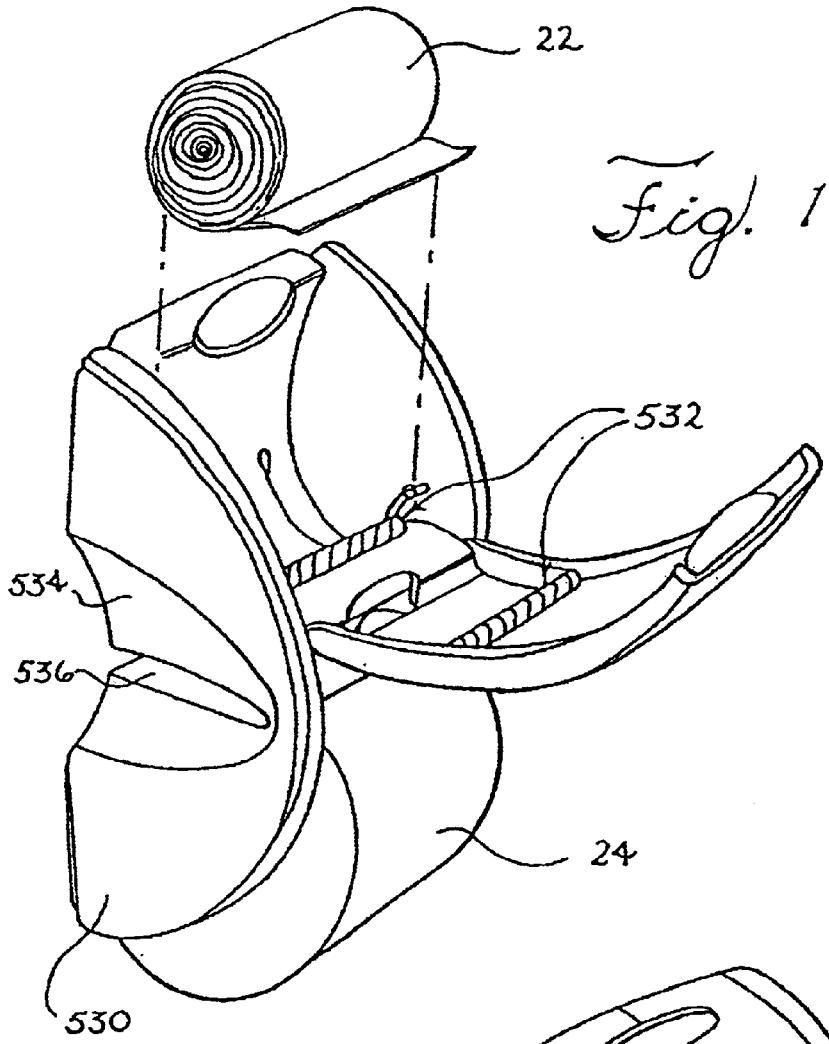
FIG. 19 is a perspective view of a dispenser.
Figure 20:
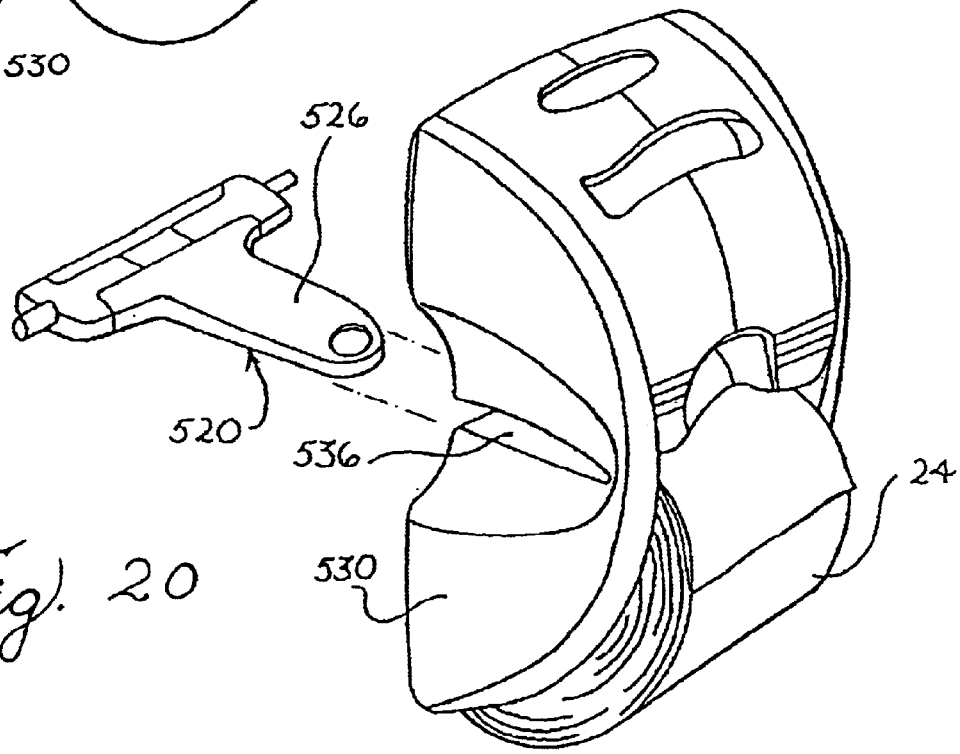
FIG. 20 is a perspective view of the mounting device and dispenser of FIGS. 18 and 19.

A mounting device 520 and dispenser 530 are illustrated in FIGS. 18–20. The mounting device 520 includes a plurality of ratchet teeth 502 and two support arms 522. The support arms 522 include distal elements 524 which are engageable with the opposed recesses of a conventional bathroom tissue fixture. The mounting device 520 is secured to a conventional fixture by manually sliding the support arms 522 outward into engagement with the fixture. Alternatively, the support arms 522 may be resiliently biased outwards by a spring or similar biasing element.

The dispenser 530 includes two dispenser guides 532 between which the premoistened wipes are dispensed. The dispenser guides advantageously include means for preventing the lateral migration of the wipes such as the lands and grooves described above. As can be seen in FIG. 19 the coreless roll 22 of premoistened wipes may be placed directly in the dispenser 530 without using a removable tray. When initially installed, the coreless roll 22 usable with the various dispensers described herein, may advantageously be dispersible in water and have an outer diameter which is approximately 3.25 inches (8.26 cm), an unwound length of approximately 37.5 feet (11.43 m) and approximately 100 individual sheets separated by perforations and having a sheet length of approximately 4.5 inches (11.43 cm).

The dispenser may include a compartment for premoistened wipes which does not including any apertures or openings other than the dispensing opening to minimize the loss of the moisture from the dispenser compartment containing the premoistened wipes.

The mounting device 520 is secured to the dispenser 530 by inserting the tongue 526 into a slot 536 in the dispenser. An engagement mechanism 514 may be used to engage the ratchet teeth 502 located on the mounting device 520. The dispenser 530 may also include a recessed portion 534 which provides space for a conventional bathroom tissue fixture.

Figure 3:
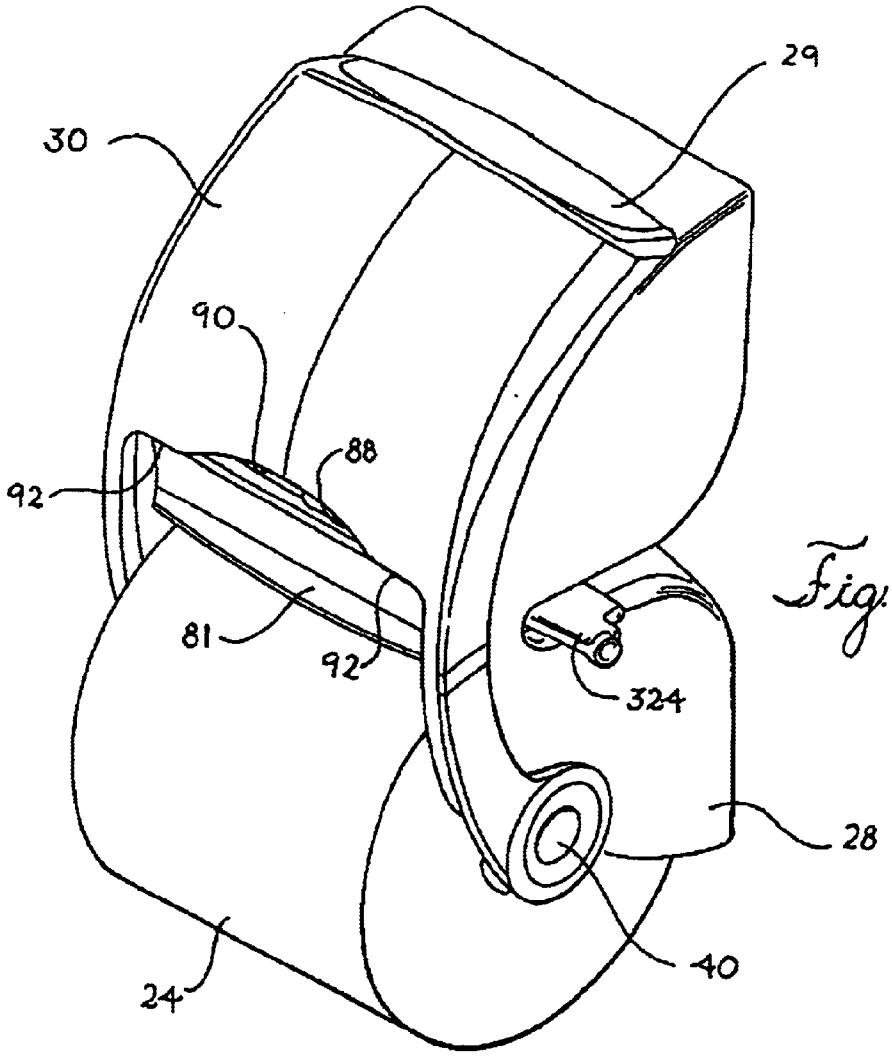
FIG. 3 is a perspective view of an alternative dispenser.
Figure 4:
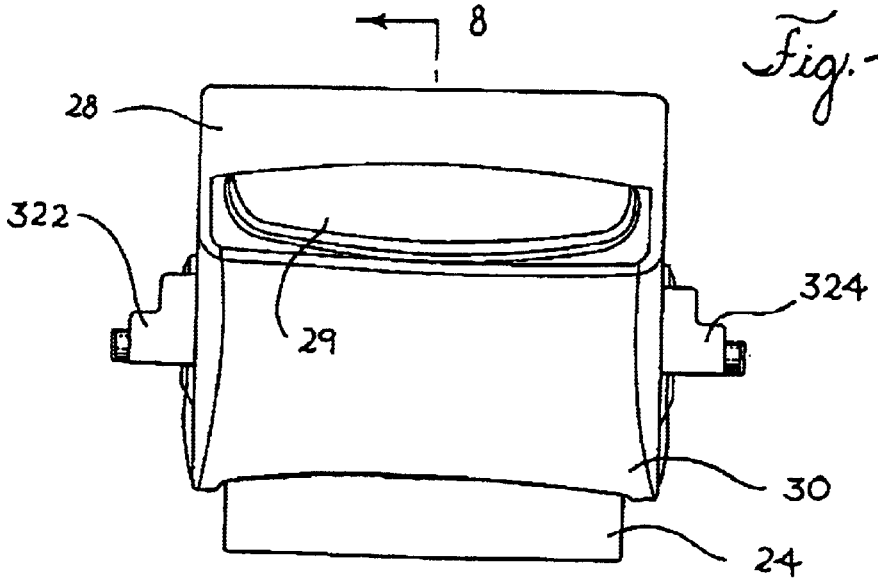
FIG. 4 is a top view of the dispenser of FIG. 3.
Figure 6:
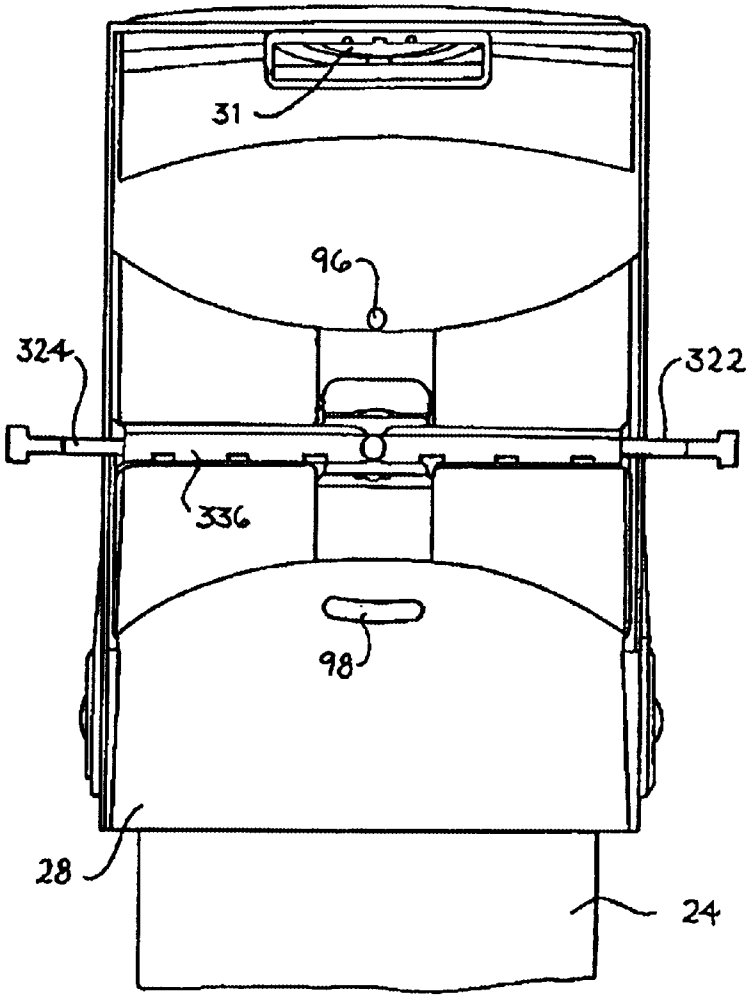
FIG. 6 is a rear view of the dispenser of FIG. 3.

FIGS. 1–10 depict an example of a dispenser having an integrated, unified appearance. As can be seen in the profile view of FIG. 7, the dispenser has a single radius of curvature, illustrated by arc 700. Referring to FIGS. 2 and 3, this radius of curvature extends from recessed portion 29, across cover 30, past impingement surface 88 and arcuate surface 81 of the tray, and to the area which may contain roll bar 40 and which may further contain a dry roll of tissue. This radius of curvature is provided at least in part by the arcuate surface of the cover 30, when the cover is in the closed position as in FIGS. 2 and 3. The curvature is substantially continuous from the top, near the convergence of the cover and the frame 28, to the front, near surfaces 81 and 88; and from the front to the bottom, near roll bar 40.

Referring to FIGS. 1 and 9, the radius of curvature may also be provided at least in part by the arcuate surface of frame 28. Frame 28 has a curved profile from its top, near recess 27, to its bottom, near apertures 34. The cover 30 has a curved profile from its top, near latching projection 31, to its bottom, near projections 36, where it is pivotally attached to the frame. When the cover is closed, the cover and frame together can provide an arcuate surface from top to bottom.

Dispensers having a single radius of curvature are also exemplified in the dispenser of FIG. 11 and in the dispenser of FIGS. 19 and 20. Referring to FIG. 19, the dispenser 530 has a curved frame and a curved cover which is pivotally attached to the frame near the front of the frame. Thus, the single radius of curvature extends from the tops of the frame and cover, past the bottom of the cover (which is attached to the front of the frame), and to the bottom of the frame. The dispensers illustrated in FIGS. 1–10 have curved covers which have pivot arms extending between the bottom of the cover and the front of the cover. In the examples of FIGS. 1–10, the single radius of curvature extends from the tops of the frame and cover, past the front of the cover, and to the bottoms of the frame and cover.

Figure 10:
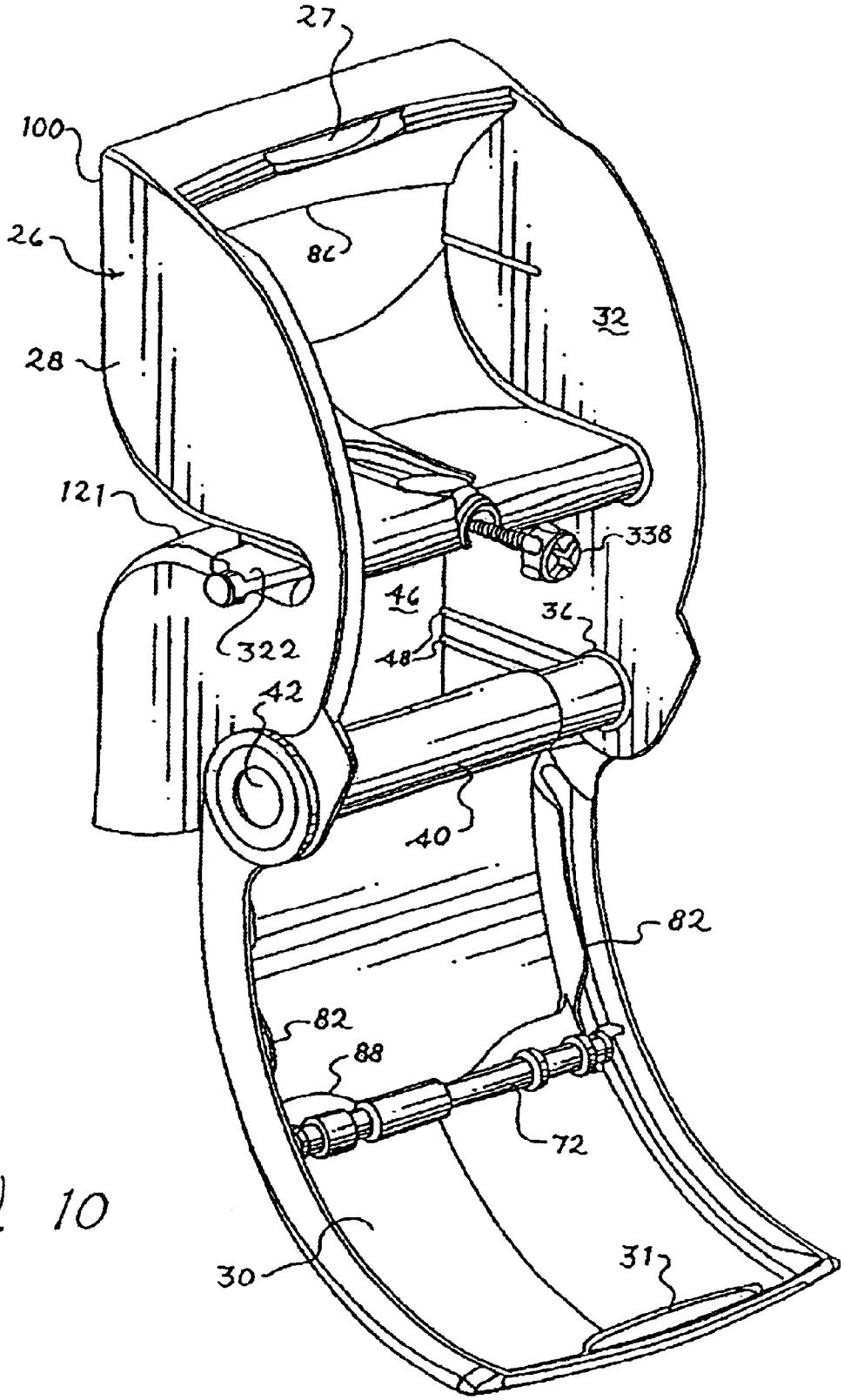
FIG. 10 is a perspective view of a dispenser housing and a mounting device.

FIGS. 1, 9 and 10 further exemplify the distribution of spaces within or associated with the dispenser. This distribution is another feature of the dispenser which contributes to the continuous curvature and the integrated, unified appearance. The frame 28 and cover 30 enclose and define a first compartment having an interior space 32, and second compartment defines a lower space 46. The interior space 32 and the lower space 46 individually define a relatively larger volume near the mounting device, and each also individually define a relatively smaller volume, near the upper and lower edges of the dispenser, respectively. Thus, the compactness of such a dispenser is enhanced by this space distribution. This compactness contributes to the unified, integrated appearance of the dispenser. The distribution of spaces, the profile of the frame, and the profile of the cover may all contribute to the arcuate surface observed in these dispensers.

Figure 5:
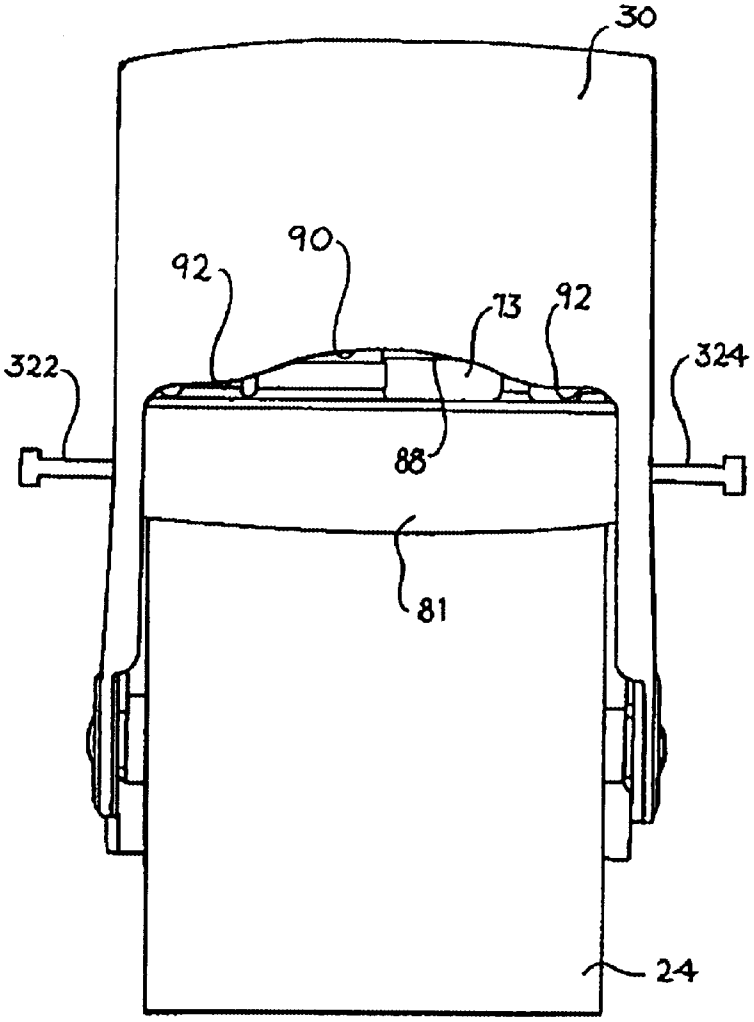
FIG. 5 is a front view of the dispenser of FIG. 3.

Referring to FIGS. 3 and 5, the mounting device is substantially obscured from view, whether observed from the front (FIG. 5) or from an angle (FIG. 3). The concealment of the mounting mechanism may be supplemented by the presence of the tray.

The dispenser system in general provides for a unified appearance when dispensing both wet wipes and dry tissue. For example, the profile and front views of the dispensing system project an appearance of tidiness rather than one of clutter. In addition, referring to FIGS. 2, 3, 11 and 19–20 the general unified appearance of the dispenser can be maintained even when the dry roll is present. The combination of the wet wipes and dry tissue into one dispenser is less likely to be perceived as having a supplemental attachment, but rather is more likely to be perceived as a unified, integrated dispensing system. This unified appearance can improve the comfort level of the user when installing and using the dispenser and the wipes and tissue from the dispenser.

While this invention has been described in detail, it will be readily apparent to a person of ordinary skill in the art that various changes and modifications can be made Without departing from the spirit and general principles of the invention. All of such changes and modifications are contemplated as being within the scope of the present invention as defined by the subjoined claims. Furthermore, this application is intended to cover such departures from the present disclosure as come within known or customary practice in the art.

What is claimed is:

1. A dispenser for wipes, comprising:

a frame having a frame top, a frame bottom, and a curved frame profile from the frame top to the frame bottom;

a cover having a cover top, a cover bottom, and a curved cover profile from the cover top to the cover bottom;

the cover pivotally attached to the frame near the cover bottom, and the cover having a closed position such that the cover top is adjacent the frame top;

a single radius of curvature from the frame top and cover top to the frame bottom when the cover is in the closed position; and a spindle for a roll of dry tissue near the bottom of the frame.

2. The dispenser of claim 1, further comprising a mounting device capable of removably attaching the dispenser to a conventional tissue holder;

wherein the mounting device is substantially hidden from view when the dispenser is attached to the conventional tissue holder.

3. The dispenser of claim 1, further comprising a tray; wherein the tray, the cover and the frame together substantially hide the mounting device from view.

4. The dispenser of claim 1, further comprising a mounting device capable of removably attaching the dispenser to a conventional tissue holder;

wherein, when the cover is in the closed position, the frame and cover together form a compartment having a first volume near the mounting device and a second volume away from the mounting device, such that the first volume is larger than the second volume.

5. The dispenser of claim 1, wherein the cover further comprises a cover front and curved pivot arms extending from the cover front to the cover bottom, wherein the cover is pivotally attached to the frame bottom by the pivot arms; and wherein the single radius of curvature extends from the frame top and cover top, through the cover front, and to the frame bottom and cover bottom when the cover is in the closed position.

6. The dispenser of claim 1, wherein the cover is pivotally attached to the frame at a frame front position between the frame top and the frame bottom; and wherein the single radius of curvature extends from the frame top and cover top, through the frame front and the cover bottom, and to the frame bottom when the cover is in the closed position.

7. A dispenser for wipes, comprising:

a frame having a frame top, a frame bottom, and a curved frame profile from the frame top to the frame bottom;

a cover having a cover top, a cover bottom, and a curved cover profile from the cover top to the cover bottom;

the cover pivotally attached to the frame near the cover bottom, and the cover having a closed position such that the cover top is adjacent the frame top;

an arcuate surface from the frame top and cover top to the frame bottom when the cover is in the closed position; and a mounting device capable of removably attaching the frame to a conventional tissue holder.

8. The dispenser of claim 7, wherein, when the cover is in the closed position, the frame and cover together form a compartment having a first volume near the mounting device and a second volume away from the mounting device, such that the first volume is larger than the second volume.

9. The dispenser of claim 8, wherein the mounting device is substantially hidden from view when the frame is attached to the conventional tissue holder.

10. The dispenser of claim 7, further comprising a spindle for a roll of dry tissue near the bottom of the frame.

11. The dispenser of claim 7, wherein the cover further comprises a cover front and curved pivot arms extending from the cover front to the cover bottom, wherein the cover is pivotally attached to the frame bottom by the pivot arms; and the arcuate surface extends from the frame top and cover top, through the cover front, and to the frame bottom and cover bottom when the cover is in the closed position.

12. The dispenser of claim 7, wherein the cover is pivotally attached to the frame at a frame front position between the frame top and the frame bottom; and wherein the arcuate surface extends from the frame top and cover top, through the frame front and the cover bottom, and to the frame bottom when the cover is in the closed position.

13. A method of dispensing wipes, comprising:

mounting a dispenser to a surface, the dispenser comprising a frame, a cover movably attached to the frame, a wipes compartment, a top, a bottom, a front between the top and bottom, and a single radius of curvature from the top through the front to the bottom;

depositing wet wipes in the wipes compartment;

closing the cover over the wet wipes such that a portion of the wipes is exposed; and removing wet wipes by pulling the exposed portion.

14. The method of claim 13, wherein the mounting comprises attaching the frame to a conventional tissue holder with a mounting device.

15. The method of claim 14, wherein the mounting device is substantially hidden from view.

16. The method of claim 13, wherein the mounting comprises attaching the frame to a wall.

17. The method of claim 13, further comprising mating a tray within the wipes compartment; wherein the depositing comprises positioning wipes in the tray within the wipes compartment.

18. The method of claim 13, wherein the frame is curved, the cover is curved, and the frame and cover together define the single radius of curvature.

19. The method of claim 13, wherein the dispenser further comprises a roll compartment comprising a spindle near the bottom; the method further comprising placing a roll of dry tissue on the spindle.

20. A dispensing system for wipes, comprising:

means for supporting wet wipes;

means for covering the wet wipes; and means for dispensing a roll of dry tissue;

wherein the covering means and the dispensing means are shaped and positioned such that a substantially continuous curvature is defined.

21. The dispensing system of claim 20, further comprising means for mounting the dispensing system to a surface.

22. The dispensing system of claim 21, wherein the mounting means is substantially hidden from view.

23. A dispensing system for wipes, comprising:

a frame comprising a frame top, a frame bottom, a frame front between the frame top and the frame bottom, and a curved frame profile from the frame top to the frame bottom;

a cover comprising a cover top, a cover bottom, and a curved cover profile from the cover top to the cover bottom;

the cover pivotally attached to the frame near the cover bottom, and the cover having a closed position such that the cover top is adjacent the frame top; and a mounting device capable of removably attaching the frame to a conventional tissue holder;

wherein, when the cover is in the closed position, the frame and cover together form a compartment having a first volume, adjacent the frame front, near the mounting device and a second volume, adjacent the frame top, away from the mounting device, such that the first volume is larger than the second volume.

24. The dispensing system of claim 23, wherein the cover is pivotally attached to the frame bottom.

25. The dispensing system of claim 23, wherein the cover is pivotally attached to the frame front.

26. The dispensing system of claim 23, wherein, when the cover is in the closed position, a single radius of curvature extends from the frame top and the cover top to the frame, and from the frame front to the frame bottom.

27. The dispensing system of claim 23, wherein the mounting device is substantially hidden from view when the frame is attached to the conventional tissue holder.

* * * * *